United States Patent [19]

Sherman

[11] Patent Number: 4,987,849

[45] Date of Patent: Jan. 29, 1991

[54] SIGNAL DEVICE

[76] Inventor: Daniel A. Sherman, 1355 Bobolink Pl., Los Angeles, Calif. 90069

[21] Appl. No.: 411,017

[22] Filed: Sep. 22, 1989

[51] Int. Cl.[5] ..... G01D 21/00

[52] U.S. Cl. ..... 116/206; 116/200

[58] Field of Search ..... 116/206, 200, 207; 283/95, 114

[56] References Cited

U.S. PATENT DOCUMENTS

| | | | |
|---|---|---|---|
| 1,009,078 | 11/1911 | MacDonald | 283/95 |
| 1,167,566 | 1/1916 | Jenkins | 283/95 |
| 2,787,238 | 4/1957 | Luce | 116/206 |
| 3,899,295 | 8/1975 | Halpern | 116/206 |
| 3,989,279 | 11/1976 | Levy | 283/95 |
| 4,160,335 | 7/1979 | Von Kohorn et al. | 43/131 |
| 4,737,463 | 4/1988 | Bhattacharjee et al. | 436/2 |
| 4,812,053 | 3/1989 | Bhattacharjee | 374/102 |
| 4,908,980 | 3/1990 | Sherman | 43/132.1 |

FOREIGN PATENT DOCUMENTS

| | | | |
|---|---|---|---|
| 117390 | 9/1984 | European Pat. Off. | 116/206 |
| 2742756 | 4/1979 | Fed. Rep. of Germany | 116/206 |
| 93983 | 5/1985 | Japan | 116/206 |

*Primary Examiner*—William A. Cuchlinski, Jr.
*Assistant Examiner*—W. Morris Worth

[57] ABSTRACT

A signal device consisting of first and second inks applied to a surface. The first ink is sensitive to either light or air. The second ink is stable in the presence of light and/or air. The surface having first and second areas, wherein the second ink is applied in work or character form to said first area to form a signal word. The first ink is applied to the second area and is of a color so as to cooperate with the second ink to camouflage the signal word. A protective shield blocks the sensitive ink from exposure to light and/or air, wherein after a metered period of time of exposure to light or air the sensitive ink fades such that the contrast in color between the faded sensitive ink and the stable ink reveals the signal word.

3 Claims, 2 Drawing Sheets

SIGNAL DEVICE

BACKGROUND OF THE INVENTION

Various products that reach the consumer and end user market are plagued with an obvious deficiency in that their ingredients, active compounds, or composition have an usable shelf life that is dependent upon the passage of time, or, as in the case of insecticide baits packaged within a closed container, become consumed in a relatively short period of time, leaving a empty container that is no longer effective in delivering a desired result.

Many attempts have been made to provide users with some type of signal or indicator that would allow them to know when the product life has been exhausted. Among these inventions are, Bhattacharjee et al-U.S. Pat. No. 4,737,463—Apr. 12, 1988—Class 436/2, Halpern—U.S. Pat. No. 3,899,295—Aug. 12, 1975—Class 23/253TP and, Bhattacharjee—U.S. Pat. 4,812,052—Mar. 14, 1989—Class 374/102.

While all these invention have greatly improved that state of the art in the use of signal devices they are deficient in that they are complicated to fabricate, dependent on external activator sources, and are expensive to manufacture.

As an example of insecticide products that would be vastly improved if the signal were incorporated in their fabrication patents have been granted to Sherman—U.S. Pat. No. 4,908,980—Mar. 20, 1990—Class 43/131, Von Konhorn, et al—U.S. Pat. No. 4,160,335—Jul. 10, 1979—Class 43/131 , and other patents within this class that contain an insecticide or rodenticide product as a component.

While all these inventions have greatly advanced the state of the art in the presentation of rodenticides and insecticides, they are deficient in that they do not allow the user to be able to determine when the product has lost it efficacy due to the passage of time or the estimated consumption of the poisoned substance contained therein.

The purpose of the instant invention is to provide an easily identifiable signal to the user, that a period of time has elapsed since the placement of the product in which either the efficacy of the product has been compromised, or in which it can be estimated that the time elapsed has resulted in spoilage or consumption of the product, thereby making it ineffective.

The use of this Signal Device, as outlined in the instant invention, will allow the consumer or purchaser of the product to be in a position to identify its freshness and usefulness in performing the task that the product has been designed for.

In addition, the Signal Device provides a lost cost, easily affordable method of "dating" a product and building into its design a fixed obsolescence based upon the manufacturers testing of the components, and life studies that have been pre-determined by the fabricator.

These and other new and useful novel features of the Signal Device will become apparent when viewed in conjunction with the description contained herein, and the accompanying art.

Care should be taken to view the Signal Device in its entirety, and the scope and use of the product transcends its description as a device that can only be used with insecticide based products, and relates to its overall use as a signal device for all products.

DETAILED DESCRIPTION OF THE DRAWINGS

Figure 1:
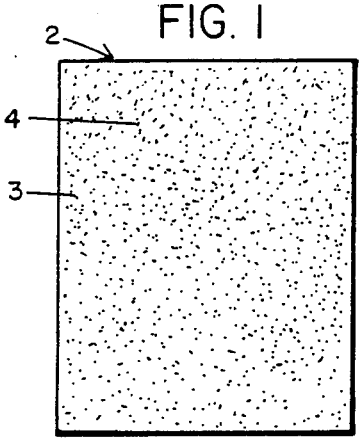
FIG. 1 shows the entire panel having been treated with a photosensitive or oxidizing agent based ink that matches the general color of the signal wording area.

In FIG. 1 we see the Signal Device described generally as 2 said device having been totally coated with an ink 3 that is generally the same color as the signal word 4. This color match between the ink 4 and the background coating 3 provides a masking or camouflage of the signal word 4 and prevents the observer from being able to decipher the word 4 at this stage of use or placement. The background ink 3 is either photo or oxidation sensitive and prior to its use has been placed behind a shield (not shown) that prevents light and/or air from reaching its surface.

Figure 2:
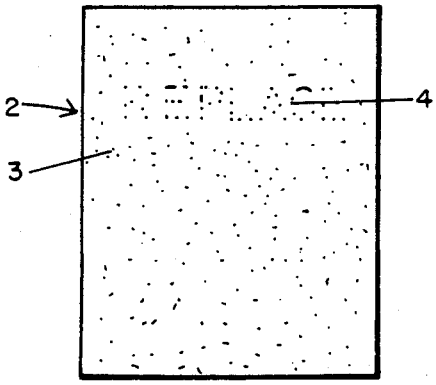
FIG. 2 demonstrates the preliminary effect of the photosensitive or oxidizing ink background as it is exposed to a normal environment and starts to fade or change color from the signal wording area.

In FIG. 2 we see the Signal Device 2 as it appears after a short duration of exposure to light and/or air. The background 3 is starting to fade while the stable ink in the signal word 4 remains consistent. The rate of fading is predetermined as a component of the amount of sensitivity of the background ink 3. Inversely, the background 3 and the signal area 4 can be inverted to produce a fading of the signal word 4 and stability in the background 3.

Figure 3:
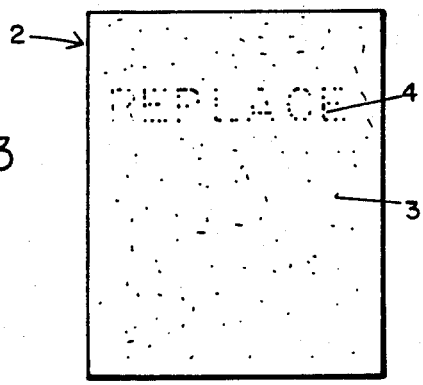
FIG. 3 show the progression of the photosensitive or oxidizing ink as the background progressively diminishes in intensity as the photosensitive or oxidizing ink fades when exposed to air and/or light.

In FIG. 3 the background 3 is shown after prolonged exposure to light and/or air producing a more visual "pop" of the signal word 4. The difference between the background 3 and the stable signal word 4 can be seen and the relative contrast between the two areas indicates that the product has either started to reach a point of ineffectiveness or has in fact reached a point of replacement.

Figure 4:
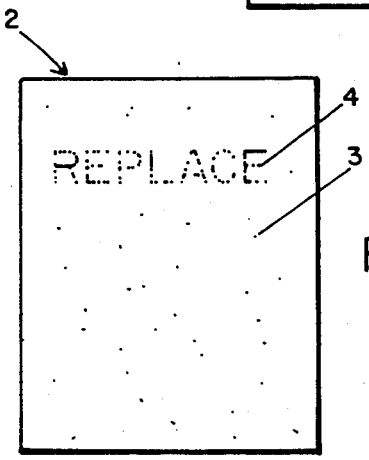
FIG. 4 again demonstrates the "pop" out effect of the stable ink printed in the signal word area as the photosensitive or oxidizing ink in the background disappears from view.

FIG. 4 demonstrates that the background 3 has faded to the point were the signal word 4 is almost totally dominant. In label instructions a user might be cautioned to wait until all the background 3 color has disappeared due to photosensitive or oxidation change leaving the signal word 4 in place.

Figure 5:
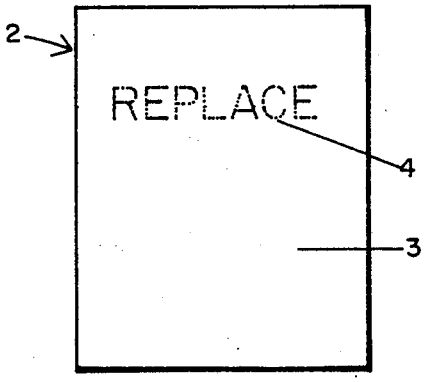
In FIG. 5 we see a final and defined appearance of the signal word, the photosensitive or oxidizing background having completely faded from view.

FIG. 5 demonstrates the total transition of the Signal Device from a camouflaged signal word 4 having been totally hidden from view by the background ink 3 to a clearly defined signal word 4 against a clear or opposing colored background 3. This "pop" of the signal word 4 from the background 3 has been accomplished by the utilization of a timed fade of the background 4 in relationship to the signal word 4. Said timing is accomplished though the use of inks that will oxidize or diminish based upon photosensitivity of the ink used.

Figure 6:
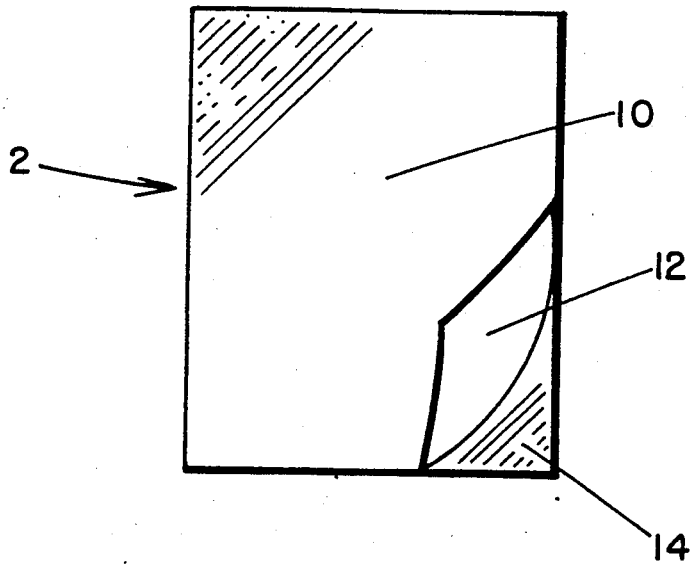
In FIG. 6 we see a depiction of the protective shield that is used to isolate the sensitive signal ink that has been placed on the surface of the device from light and/or air.

FIG. 6 shows the Signal Device 2 which has been covered by a protective shield 10 that blocks either of light or air from reaching the surface 14 of the Signal Device 2. The protective shield 10 is peeled back by lifting a corner of shield 10 and folding it back 12, thereby allowing the protective shield 10 to be removed from the device and exposing the surface 14 of the signal device to contact with ambient light and/or air.

What I claim is:

1. A signal device consisting of first and second inks applied to a surface; said first ink being sensitive to light; said second ink being stable in the presence of light and/or air; said surface having first and second areas, wherein said second ink is applied in word or character form to said first area to form a signal word; said first ink is applied to said second area and being of a color so as to cooperate with said second ink to camouflage the signal word; a protective shield means to block said sensitive ink from exposure to light or air; and wherein after a metered period of time of exposure to light said sensitive ink fades such that the contrast in color between the faded sensitive ink and stable ink reveals said signal word.

2. A signal device as in claim 1, wherein said sensitive ink is sensitive to air; and wherein after a metered period of time of exposure to air said sensitive ink fades such that the contrast between the faded sensitive ink and stable ink reveals said signal word.

3. A signal device as in claims 1 or 2, wherein the signal word is formed using said sensitive ink and said stable ink is applied so as to camouflage the signal word.

* * * * *